US009334858B2

(12) United States Patent
Locke et al.

(10) Patent No.: US 9,334,858 B2
(45) Date of Patent: May 10, 2016

(54) DISC PUMP WITH PERIMETER VALVE CONFIGURATION

(71) Applicant: KCI Licensing, Inc., San Antonio, TX (US)

(72) Inventors: Christopher Brian Locke, Bournemouth (GB); Aidan Marcus Tout, Alderbury (GB)

(73) Assignee: KCI Licensing, Inc., San Antonio, TX (US)

( * ) Notice: Subject to any disclaimer, the term of this patent is extended or adjusted under 35 U.S.C. 154(b) by 418 days.

(21) Appl. No.: 13/864,002

(22) Filed: Apr. 16, 2013

(65) Prior Publication Data

US 2013/0280105 A1 Oct. 24, 2013

Related U.S. Application Data

(60) Provisional application No. 61/635,655, filed on Apr. 19, 2012.

(51) Int. Cl.
*F04B 17/00* (2006.01)
*F04B 19/00* (2006.01)
(Continued)

(52) U.S. Cl.
CPC ..... *F04B 17/003* (2013.01); *F04B 19/006* (2013.01); *F04B 43/0018* (2013.01); *F04B 43/0054* (2013.01); *F04B 43/028* (2013.01); *F04B 43/046* (2013.01)

(58) Field of Classification Search
CPC .... F04B 43/028; F04B 43/046; F04B 43/043; F04B 43/02; F04B 43/0054; F04B 43/0018; F04B 19/006
USPC ..... 417/479
See application file for complete search history.

(56) References Cited

U.S. PATENT DOCUMENTS 1,355,846 A 10/1920 Rannells
2,547,758 A 4/1951 Keeling
(Continued)

FOREIGN PATENT DOCUMENTS

AU 550575 A1 3/1986
AU 745271 4/1999
(Continued)

OTHER PUBLICATIONS

N.A. Bagautdinov, "Variant of External Vacuum Aspiration in the Treatment of Purulent Diseases of the Soft Tissues," Current Problems in Modern Clinical Surgery: Interdepartmental Collection, edited by V. Ye Volkov et al. (Chuvashia State University, Cheboksary, U.S.S.R. 1986);pp. 94-96 (certified translation).
(Continued)

*Primary Examiner* — Justin Jonaitis
*Assistant Examiner* — Stephen Mick

(57) ABSTRACT

A disc pump valve includes an elliptical pump base having at least one aperture extending through the base. The base comprises a first end wall and a sealing surface. The pump includes an isolator overlying the base and having an isolator valve aperture extending through the isolator at or near the periphery of the isolator and partially overlying a cavity formed by the base to form an outlet. In addition, the disc pump includes a valve flap disposed between the pump base and the isolator. The flap has apertures arranged about its periphery, beyond the periphery of the cavity but underlying an isolator valve aperture. The flap seals against the sealing surface to close the pump outlet and prevent fluid from flowing from the outlet into the cavity and flexes away from the sealing surface to allow fluid to pass from the cavity through the pump outlet.

27 Claims, 7 Drawing Sheets

(51) Int. Cl.

| | |
|---|---|
| ***F04B 43/00*** | (2006.01) |
| ***F04B 43/02*** | (2006.01) |
| ***F04B 43/04*** | (2006.01) |

(56) References Cited

U.S. PATENT DOCUMENTS

| | | | |
|---|---|---|---|
| 2,632,443 | A | 3/1953 | Lesher |
| 2,682,873 | A | 7/1954 | Evans et al. |
| 2,910,763 | A | 11/1959 | Lauterbach |
| 2,969,057 | A | 1/1961 | Simmons |
| 3,066,672 | A | 12/1962 | Crosby, Jr. et al. |
| 3,367,332 | A | 2/1968 | Groves |
| 3,520,300 | A | 7/1970 | Flower, Jr. |
| 3,568,675 | A | 3/1971 | Harvey |
| 3,648,692 | A | 3/1972 | Wheeler |
| 3,682,180 | A | 8/1972 | McFarlane |
| 3,826,254 | A | 7/1974 | Mellor |
| 4,080,970 | A | 3/1978 | Miller |
| 4,096,853 | A | 6/1978 | Weigand |
| 4,139,004 | A | 2/1979 | Gonzalez, Jr. |
| 4,165,748 | A | 8/1979 | Johnson |
| 4,184,510 | A | 1/1980 | Murry et al. |
| 4,233,969 | A | 11/1980 | Lock et al. |
| 4,245,630 | A | 1/1981 | Lloyd et al. |
| 4,256,109 | A | 3/1981 | Nichols |
| 4,261,363 | A | 4/1981 | Russo |
| 4,275,721 | A | 6/1981 | Olson |
| 4,284,079 | A | 8/1981 | Adair |
| 4,297,995 | A | 11/1981 | Golub |
| 4,333,468 | A | 6/1982 | Geist |
| 4,373,519 | A | 2/1983 | Errede et al. |
| 4,382,441 | A | 5/1983 | Svedman |
| 4,392,853 | A | 7/1983 | Muto |
| 4,392,858 | A | 7/1983 | George et al. |
| 4,419,097 | A | 12/1983 | Rowland |
| 4,465,485 | A | 8/1984 | Kashmer et al. |
| 4,475,909 | A | 10/1984 | Eisenberg |
| 4,480,638 | A | 11/1984 | Schmid |
| 4,525,166 | A | 6/1985 | Leclerc |
| 4,525,374 | A | 6/1985 | Vaillancourt |
| 4,540,412 | A | 9/1985 | Van Overloop |
| 4,543,100 | A | 9/1985 | Brodsky |
| 4,548,202 | A | 10/1985 | Duncan |
| 4,551,139 | A | 11/1985 | Plaas et al. |
| 4,569,348 | A | 2/1986 | Hasslinger |
| 4,605,399 | A | 8/1986 | Weston et al. |
| 4,608,041 | A | 8/1986 | Nielson |
| 4,640,688 | A | 2/1987 | Hauser |
| 4,655,754 | A | 4/1987 | Richmond et al. |
| 4,664,662 | A | 5/1987 | Webster |
| 4,710,165 | A | 12/1987 | McNeil et al. |
| 4,733,659 | A | 3/1988 | Edenbaum et al. |
| 4,743,232 | A | 5/1988 | Kruger |
| 4,758,220 | A | 7/1988 | Sundblom et al. |
| 4,787,888 | A | 11/1988 | Fox |
| 4,826,494 | A | 5/1989 | Richmond et al. |
| 4,838,883 | A | 6/1989 | Matsuura |
| 4,840,187 | A | 6/1989 | Brazier |
| 4,863,449 | A | 9/1989 | Therriault et al. |
| 4,872,450 | A | 10/1989 | Austad |
| 4,878,901 | A | 11/1989 | Sachse |
| 4,897,081 | A | 1/1990 | Poirier et al. |
| 4,906,233 | A | 3/1990 | Moriuchi et al. |
| 4,906,240 | A | 3/1990 | Reed et al. |
| 4,919,654 | A | 4/1990 | Kalt et al. |
| 4,941,882 | A | 7/1990 | Ward et al. |
| 4,953,565 | A | 9/1990 | Tachibana et al. |
| 4,969,880 | A | 11/1990 | Zamierowski |
| 4,985,019 | A | 1/1991 | Michelson |
| 5,037,397 | A | 8/1991 | Kalt et al. |
| 5,086,170 | A | 2/1992 | Luheshi et al. |
| 5,092,858 | A | 3/1992 | Benson et al. |
| 5,100,396 | A | 3/1992 | Zamierowski |
| 5,134,994 | A | 8/1992 | Say |
| 5,149,331 | A | 9/1992 | Ferdman et al. |
| 5,167,613 | A | 12/1992 | Karami et al. |
| 5,176,663 | A | 1/1993 | Svedman et al. |
| 5,215,522 | A | 6/1993 | Page et al. |
| 5,232,453 | A | 8/1993 | Plass et al. |
| 5,261,893 | A | 11/1993 | Zamierowski |
| 5,278,100 | A | 1/1994 | Doan et al. |
| 5,279,550 | A | 1/1994 | Habib et al. |
| 5,298,015 | A | 3/1994 | Komatsuzaki et al. |
| 5,342,376 | A | 8/1994 | Ruff |
| 5,344,415 | A | 9/1994 | DeBusk et al. |
| 5,358,494 | A | 10/1994 | Svedman |
| 5,437,622 | A | 8/1995 | Carion |
| 5,437,651 | A | 8/1995 | Todd et al. |
| 5,527,293 | A | 6/1996 | Zamierowski |
| 5,549,584 | A | 8/1996 | Gross |
| 5,556,375 | A | 9/1996 | Ewall |
| 5,607,388 | A | 3/1997 | Ewall |
| 5,636,643 | A | 6/1997 | Argenta et al. |
| 5,645,081 | A | 7/1997 | Argenta et al. |
| 6,071,267 | A | 6/2000 | Zamierowski |
| 6,135,116 | A | 10/2000 | Vogel et al. |
| 6,241,747 | B1 | 6/2001 | Ruff |
| 6,287,316 | B1 | 9/2001 | Agarwal et al. |
| 6,345,623 | B1 | 2/2002 | Heaton et al. |
| 6,488,643 | B1 | 12/2002 | Tumey et al. |
| 6,493,568 | B1 | 12/2002 | Bell et al. |
| 6,553,998 | B2 | 4/2003 | Heaton et al. |
| 6,814,079 | B2 | 11/2004 | Heaton et al. |
| 2002/0077661 | A1 | 6/2002 | Saadat |
| 2002/0115951 | A1 | 8/2002 | Norstrem et al. |
| 2002/0120185 | A1 | 8/2002 | Johnson |
| 2002/0143286 | A1 | 10/2002 | Tumey |
| 2002/0168278 | A1* | 11/2002 | Jeon ..... B01L 3/502707 417/559 |
| 2004/0063217 | A1* | 4/2004 | Webster ..... B01L 3/50273 436/180 |
| 2004/0074768 | A1* | 4/2004 | Anex ..... F04B 17/00 204/294 |
| 2004/0118865 | A1* | 6/2004 | Maruyama ..... B05C 5/0225 222/1 |
| 2006/0076068 | A1* | 4/2006 | Young ..... B01F 5/0683 137/829 |
| 2006/0232167 | A1 | 10/2006 | Jordan |
| 2007/0240989 | A1* | 10/2007 | Levitan ..... B01F 13/0076 204/451 |
| 2009/0148318 | A1* | 6/2009 | Kamitani ..... F04B 43/04 417/413.2 |
| 2009/0188576 | A1* | 7/2009 | Kang ..... F04B 43/043 137/831 |
| 2010/0074775 | A1 | 3/2010 | Yamamoto et al. |
| 2010/0310398 | A1* | 12/2010 | Janse Van Rensburg . F04F 7/00 417/488 |
| 2011/0081267 | A1 | 4/2011 | McCrone et al. |
| 2011/0186765 | A1* | 8/2011 | Jaeb ..... F04B 43/046 251/331 |
| 2011/0190670 | A1 | 8/2011 | Jaeb et al. |

FOREIGN PATENT DOCUMENTS

| | | | |
|---|---|---|---|
| AU | 755496 | | 2/2002 |
| CA | 2005436 | | 6/1990 |
| DE | 26 40 413 | A1 | 3/1978 |
| DE | 43 06 478 | A1 | 9/1994 |
| DE | 295 04 378 | U1 | 10/1995 |
| EP | 0100148 | A1 | 2/1984 |
| EP | 0117632 | A2 | 9/1984 |
| EP | 0161865 | A2 | 11/1985 |
| EP | 0358302 | A2 | 3/1990 |
| EP | 1018967 | B1 | 8/2004 |
| GB | 692578 | | 6/1953 |
| GB | 2 195 255 | A | 4/1988 |
| GB | 2 197 789 | A | 6/1988 |
| GB | 2 220 357 | A | 1/1990 |
| GB | 2 235 877 | A | 3/1991 |
| GB | 2 329 127 | B | 3/1999 |
| GB | 2 333 965 | A | 8/1999 |
| JP | 4129536 | | 4/1992 |
| SG | 71559 | | 4/2002 |
| WO | 80/02182 | | 10/1980 |

(56) References Cited

FOREIGN PATENT DOCUMENTS

| | | |
|---|---|---|
| WO | 87/04626 | 8/1987 |
| WO | 90/10424 | 9/1990 |
| WO | 93/09727 | 5/1993 |
| WO | 94/20041 | 9/1994 |
| WO | 96/05873 | 2/1996 |
| WO | 97/18007 | 5/1997 |
| WO | 99/13793 | 3/1999 |

OTHER PUBLICATIONS

Louis C. Argenta, MD and Michael J. Morykwas, PhD; "Vacuum-Assisted Closure: A New Method for Wound Control and Treatment: Animal Studies & Basic Foundation"; Annals of Plastic Surgery, vol. 38, No. 6, Jun. 1997; pp. 553-562.
Susan Mendez-Eastmen, RN; "When Wounds Won't Heal" RN Jan. 1998, vol. 61 (1); Medical Economics Company, Inc., Montvale, NJ, USA; pp. 20-24.
James H. Blackburn, II, MD, et al; "Negative-Pressure Dressings as a Bolster for Skin Grafts"; Annals of Plastic Surgery, vol. 40, No. 5, May 1998, pp. 453-457.
John Masters; "Reliable, Inexpensive and Simple Suction Dressings"; Letters to the Editor, British Journal of Plastic Surgery, 1998, vol. 51 (3), p. 267; Elsevier Science/The British Association of Plastic Surgeons, UK.
S.E. Greer, et al "The Use of Subatmospheric Pressure Dressing Therapy to Close Lymphocutaneous Fistulas of the Groin" British Journal of Plastic Surgery (2000), vol. 53, pp. 484-487.
George V. Letsou, MD., et al; "Stimulation of Adenylate Cyclase Activity in Cultured Endothelial Cells Subjected to Cyclic Stretch"; Journal of Cardiovascular Surgery, vol. 31, 1990, pp. 634-639.
Orringer, Jay, et al; "Management of Wounds in Patients with Complex Enterocutaneous Fistulas"; Surgery, Gynecology & Obstetrics, Jul. 1987, vol. 165, pp. 79-80.
International Search Report for PCT International Application PCT/GB95/01983; Nov. 23, 1995.
PCT International Search Report for PCT International Application PCT/GB98/02713; Jan. 8, 1999.
PCT Written Opinion; PCT International Application PCT/GB98/02713; Jun. 8, 1999.
PCT International Examination and Search Report, PCT International Application PCT/GB96/02802; Jan. 15, 1998 & Apr. 29, 1997.
PCT Written Opinion, PCT International Application PCT/GB96/02802; Sep. 3, 1997.
Dattilo, Philip P., Jr., et al; "Medical Textiles: Application of an Absorbable Barbed Bi-directional Surgical Suture"; Journal of Textile and Apparel, Technology and Management, vol. 2, Issue 2, Spring 2002, pp. 1-5.
Kostyuchenok, B.M., et al; "Vacuum Treatment in the Surgical Management of Purulent Wounds"; Vestnik Khirurgi, Sep. 1986, pp. 18-21 and 6 page English translation thereof.
Davydov, Yu. A., et al; "Vacuum Therapy in the Treatment of Purulent Lactation Mastitis"; Vestnik Khirurgi, May 14, 1986, pp. 66-70, and 9 page English translation thereof.
Yusupov. Yu. N., et al; "Active Wound Drainage", Vestnik Khirurgi, vol. 138, Issue 4, 1987, and 7 page English translation thereof.
Davydov, Yu. A., et al; "Bacteriological and Cytological Assessment of Vacuum Therapy for Purulent Wounds"; Vestnik Khirurgi, Oct. 1988, pp. 48-52, and 8 page English translation thereof.
Davydov, Yu. A., et al; "Concepts for the Clinical-Biological Management of the Wound Process in the Treatment of Purulent Wounds by Means of Vacuum Therapy"; Vestnik Khirurgi, Jul. 7, 1980, pp. 132-136, and 8 page English translation thereof.
Chariker, Mark E., M.D., et al; "Effective Management of incisional and cutaneous fistulae with closed suction wound drainage"; Contemporary Surgery, vol. 34, Jun. 1989, pp. 59-63.
Egnell Minor, Instruction Book, First Edition, 300 7502, Feb. 1975, pp. 24.
Egnell Minor: Addition to the Users Manual Concerning Overflow Protection—Concerns all Egnell Pumps, Feb. 3, 1983, p. 1.
Svedman, P.: "Irrigation Treatment of Leg Ulcers", The Lancet, Sep. 3, 1983, pp. 532-534.
Chinn, Steven D. et al.: "Closed Wound Suction Drainage", The Journal of Foot Surgery, vol. 24, No. 1, 1985, pp. 76-81.
Arnljots, Björn et al.: "Irrigation Treatment in Split-Thickness Skin Grafting of Intractable Leg Ulcers", Scand J. Plast Reconstr. Surg., vol. 19, 1985, pp. 211-213.
Svedman, P.: "A Dressing Allowing Continuous Treatment of a Biosurface", IRCS Medical Science: Biomedical Technology, Clinical Medicine, Surgery and Transplantation, vol. 7, 1979, p. 221.
Svedman, P. et al.: "A Dressing System Providing Fluid Supply and Suction Drainage Used for Continuous or Intermittent Irrigation", Annals of Plastic Surgery, vol. 17, No. 2, Aug. 1986, pp. 125-133.
K.F. Jeter, T.E. Tintle, and M. Chariker, "Managing Draining Wounds and Fistulae: New and Established Methods," Chronic Wound Care, edited by D. Krasner (Health Management Publications, Inc., King of Prussia, PA 1990), pp. 240-246.
G. Živadinovic, V. Đ ukić, Ž. Maksimović, Đ Radak, and P. Peška, "Vacuum Therapy in the Treatment of Peripheral Blood Vessels," Timok Medical Journal 11 (1986), pp. 161-164 (certified translation).
F.E. Johnson, "An Improved Technique for Skin Graft Placement Using a Suction Drain," Surgery, Gynecology, and Obstetrics 159 (1984), pp. 584-585.
A.A. Safronov, Dissertation Abstract, Vacuum Therapy of Trophic Ulcers of the Lower Leg with Simultaneous Autoplasty of the Skin (Central Scientific Research Institute of Traumatology and Orthopedics, Moscow, U.S.S.R. 1967) (certified translation).
M. Schein, R. Saadia, J.R. Jamieson, and G.A.G. Decker, "The 'Sandwich Technique' in the Management of the Open Abdomen," British Journal of Surgery 73 (1986), pp. 369-370.
D.E. Tribble, "An Improved Sump Drain-Irrigation Device of Simple Construction," Archives of Surgery 105 (1972) pp. 511-513.
C.E. Tennant, "The Use of Hypermia in the Postoperative Treatment of Lesions of the Extremities and Thorax," Journal of the American Medical Association 64 (1915), pp. 1548-1549.
Selections from W. Meyer and V. Schmieden, Bier's Hyperemic Treatment in Surgery, Medicine, and the Specialties: A Manual of its Practical Application, (W.B. Saunders Co., Philadelphia, PA 1909), pp. 17-25, 44-64, 90-96, 167-170, and 210-211.
V.A. Solovev et al., Guidelines, The Method of Treatment of Immature External Fistulas in the Upper Gastrointestinal Tract, editor-in-chief Prov. V.I. Parahonyak (S.M. Kirov Gorky State Medical Institute, Gorky, U.S.S.R. 1987) ("Solovev Guidelines").
V.A. Kuznetsov & N.A. Bagautdinov, "Vacuum and Vacuum-Sorption Treatment of Open Septic Wounds," in II All-Union Conference on Wounds and Wound Infections: Presentation Abstracts, edited by B.M. Kostyuchenok et al. (Moscow, U.S.S.R. Oct. 28-29, 1986) pp. 91-92 ("Bagautdinov II").
V.A. Solovev, Dissertation Abstract, Treatment and Prevention of Suture Failures after Gastric Resection (S.M. Kirov Gorky State Medical Institute, Gorky, U.S.S.R. 1988) ("Solovev Abstract").
V.A.C.® Therapy Clinical Guidelines: A Reference Source for Clinicians (Jul. 2007).
International Search Report and Written Opinion for corresponding PCT/US2013/036805 mailed Jul. 4, 2013.

* cited by examiner

+ΔP
P
PRESSURE
TIME
-ΔP
tp
tp+

OPEN
PERIMETER
VALVES
δgap
CLOSED
TIME
To
to
Tc
tc

FLOW+
+ PRESSURE
TIME
FLOW-
- PRESSURE

DISC PUMP WITH PERIMETER VALVE CONFIGURATION

The present invention claims the benefit, under 35 USC §119(e), of the filing of U.S. Provisional Patent Application Ser. No. 61/635,655, entitled "DISC PUMP WITH PERIMETER VALVE CONFIGURATION," filed Apr. 19, 2012, by Locke et al., which is incorporated herein by reference for all purposes.

BACKGROUND OF THE INVENTION

1. Field of the Invention

The illustrative embodiments relate generally to a disc-pump valve for managing fluid flow therethrough and, more specifically, but not by way of limitation, to a disc pump having a perimeter valve configuration.

2. Description of Related Art

Conventional valves typically operate at frequencies below 500 Hz. For example, many conventional compressors typically operate at 50 or 60 Hz. A linear resonance compressor known in the art operates between 150 and 350 Hz. Some applications, require valves that are capable of operating at much higher frequencies, 20 kHz and higher, for example. Valves that operate at these high frequencies are not commonly available. For example, many portable electronic devices, including medical devices, require pumps that are relatively small in size to deliver a positive pressure or to provide a vacuum. Consequently, these relatively small pumps require even smaller valves that must operate at very high frequencies to be effective. Moreover, these valves must operate at frequencies beyond the range of human hearing so that the valves are inaudible in operation. To operate at these high frequencies, the valve must be responsive to a high frequency oscillating pressure that can be rectified to create a net flow of fluid through the pump.

SUMMARY

According to an illustrative embodiment, a disc pump valve for controlling the flow of fluid through a disc pump includes a pump base having an elliptical shape and at least one aperture extending through the pump base. The pump base comprises a first end wall and a sealing surface. The disc pump also includes an isolator overlying the pump base, the isolator having an isolator valve aperture extending through the isolator at or near the periphery of the isolator and partially overlying the cavity to form an outlet. In addition, the disc pump includes a valve flap disposed between the pump base and the isolator. The valve flap has one or more valve flap apertures arranged about the periphery of the valve flap beyond the periphery of the cavity and underlying an isolator valve aperture. The valve flap seals against the sealing surface to close the pump outlet and prevent fluid from flowing from the pump outlet through the cavity. The valve flap also flexes away from the sealing surface to allow fluid to pass from the cavity through the pump outlet.

According to another illustrative embodiment, a disc pump valve for controlling the flow of fluid through a disc pump comprises a pump base having an elliptical shape and at least one aperture extending through the pump base, the pump base comprising a first end wall and a sealing surface. An isolator overlies the pump base and has an isolator valve aperture extending through the isolator at or near the periphery of the isolator and partially overlying the cavity to form an outlet. A valve flap is disposed between the pump base and the isolator. The valve flap has one or more valve flap apertures that are arranged about the periphery of the valve flap beyond the periphery of the cavity and underlying an isolator valve aperture. The disc pump valve also includes a plurality of isolator valve apertures, each of the isolator valve apertures extending through the isolator at or near the periphery of the isolator and partially overlying the cavity to form a plurality of pump outlets. In addition, the disc pump valve includes a plurality of valve flap apertures. Each of the valve flap apertures are arranged about the periphery of the valve flap beyond the periphery of the cavity, and underlying an isolator valve aperture. Each of the isolator valve apertures overlies a plurality of valve flap apertures. The valve flap seals against the sealing surface to close the pump outlet and prevent fluid from flowing from the pump outlet through the cavity. The valve flap flexes away from the sealing surface to allow fluid to pass from the cavity through the pump outlet.

Other objects, features, and advantages of the illustrative embodiments are disclosed herein and will become apparent with reference to the drawings and detailed description that follow.

DETAILED DESCRIPTION OF ILLUSTRATIVE EMBODIMENTS

In the following detailed description of illustrative embodiments, reference is made to the accompanying drawings that form a part hereof. By way of illustration, the drawings show specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

A micropump, such as a disc pump, is a suitable application for a valve that operates at a high frequency, e.g., beyond the range of human hearing. At such frequencies, the pump may be extremely small in size and suitable for integration into a wide range of portable electronic devices where pressure or vacuum delivery is required. The disc pump may include an actuator, such as a piezoelectric actuator, to cause oscillatory motion and displacement oscillations of a driven end wall within the disc pump. When the actuator generates an oscillatory motion of the end wall, the displacement oscillations may generate radial oscillations of the fluid pressure within the pump. These radial oscillation of fluid pressure may cause fluid to flow through apertures in the pump base and apertures in the end wall, which may be inlet apertures and outlet apertures, respectively. To generate a pressure differential, the pump includes one or more valves that allow fluid to flow through the disc pump in only one direction. For the valves to operate at the high frequencies generated by the actuator, the valves may have an extremely fast response time such that the valves are able to open and close on a time scale that is shorter than the time scale of the pressure variations.

Figure 1:
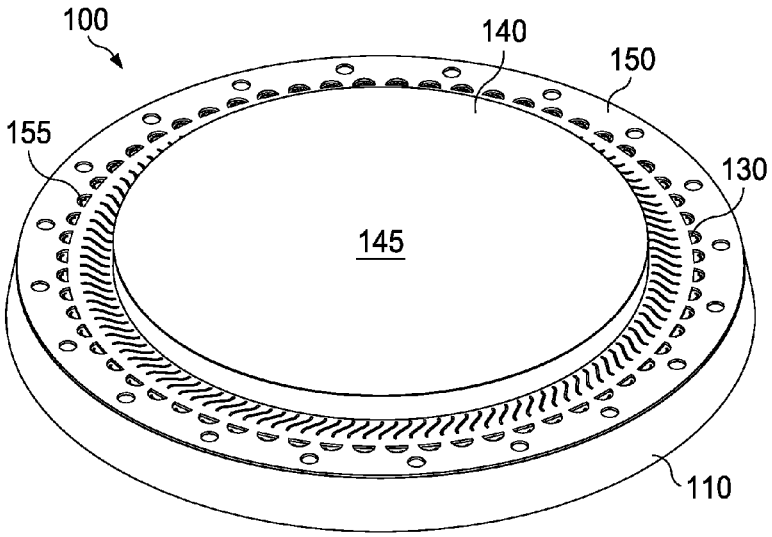
FIG. 1 shows a perspective view of an illustrative embodiment of a disc pump having a perimeter valve configuration.
Figure 2:
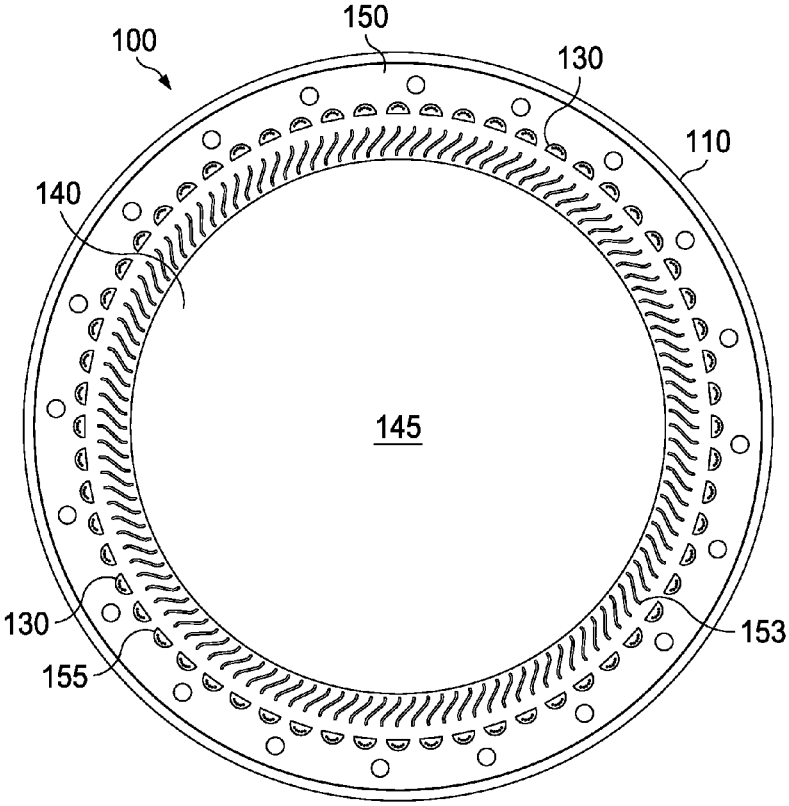
FIG. 2 shows a top view of the disc pump of FIG. 1.
Figure 3:
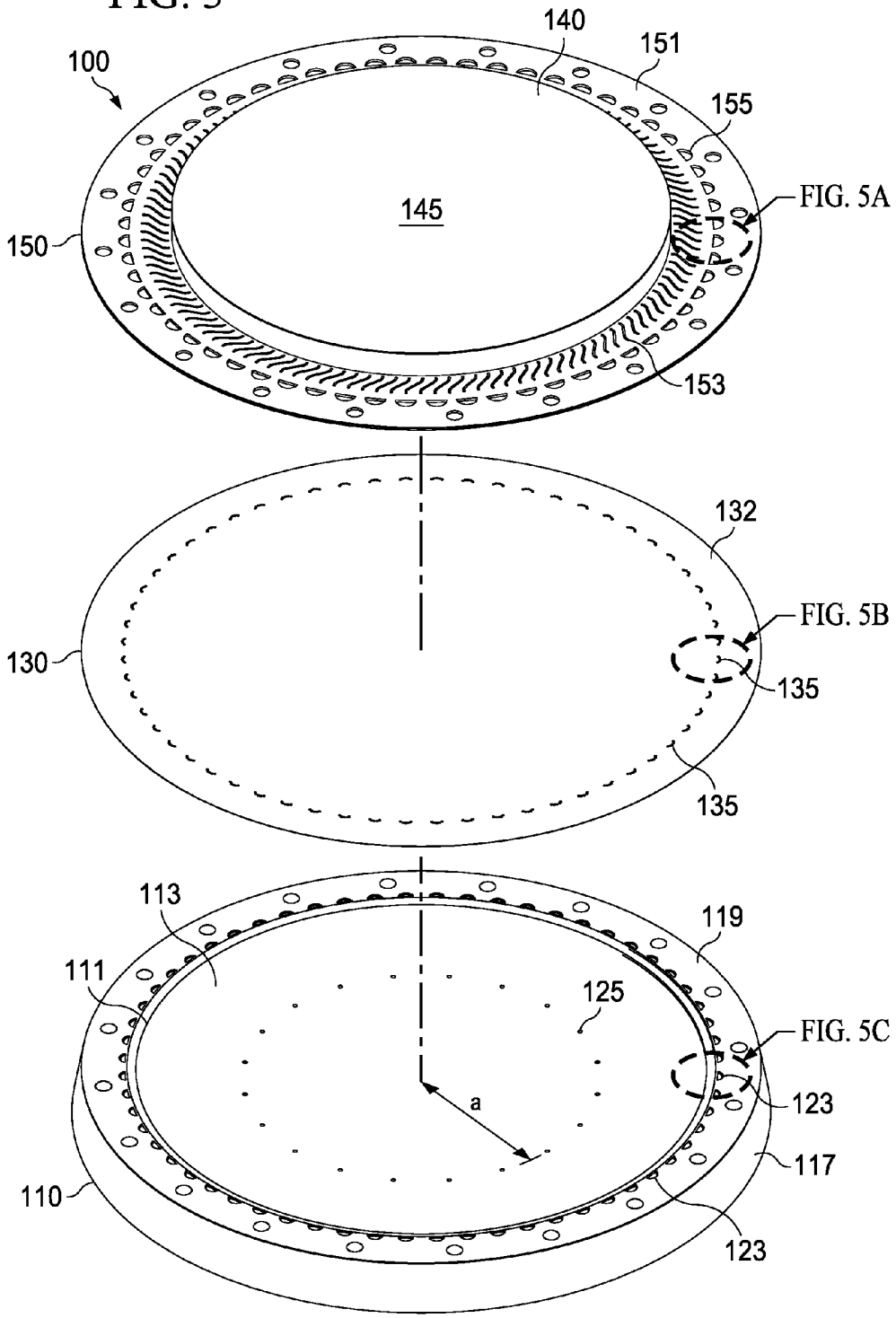
FIG. 3 shows an exploded, perspective view of the disc pump of FIG. 1.

Referring now to FIGS. 1-5C and more specifically to the assembled, perspective view of FIG. 1, an illustrative embodiment of a disc pump 100 is shown. The disc pump 100 comprises a pump base 110, a valve flap 130, and an actuator 140 as shown in the exploded, perspective view of FIG. 3. The actuator 140 further comprises a piezoelectric disc 145 and an isolator 150 mechanically coupled to the piezoelectric disc 145. The pump base 110 comprises a generally cylindrical sidewall 111 closed at one end by a first end wall 113 to form a cavity 115 within the pump base 110. The first end wall 113 may be generally planar or frusto-conical in shape as will be discussed in more detail below. The frusto-conical shape of the first end wall 113 may be, for example, deeper in the central portion of the pump base 110 and tapering upwardly toward the side wall 111. The pump base 110 further comprises a base 116, an external sidewall 117, and an upper surface 119 having a ring-like shape extending between the sidewall 111 and the external sidewall 117. The upper surface 119 of the pump base 110 includes a sealing surface 121 adjacent the periphery of the side wall 111 and a plurality of indentations 123 extending radially from the sealing surface 121 below the upper surface 119. The pump base 110 further comprises apertures 125 extending from the first end wall 113 and out of the base 116. The apertures 125 may be positioned circumferentially around the base 116 at a predetermined radius (a) from the center of the first end wall 113.

The valve flap 130 is generally circular in shape having a cavity-facing surface and an isolator-facing surface 132. The cavity-facing surface has a central portion that forms a second end wall 131 that closes the cavity 115 of the pump base 110 and a peripheral portion 133 extending from the side wall 111 to cover the upper surface 119 of the pump base 110 on which the valve flap 130 is mounted. The valve flap 130 comprises perforations 135 positioned along the peripheral portion 133 of the valve flap 130, each one of which is aligned over the indentations 123 in the upper surface 119 of the pump base 110. The perforations 135 may include a plurality of the valve-flap apertures 531-535 (see, for example, FIG. 5B) extending through the valve flap 130 to a single indentation 123 to provide a path for fluid flow. The valve-flap apertures 531-535 may be arranged in a pattern to accommodate the geometry of the indentations 123 in the upper surface 119. For example, valve-flap apertures 531-535 may be arranged in an arcuate pattern to be adjacent the outer periphery of the indentation 123. The pattern and quantity of valve flap apertures 531-535 may be varied to control the total flow of fluid through the disc pump 100 as desired. For example, the number of valve flap apertures 531-535 may be increased to increase the flow of fluid through the disc pump 100. Similarly, the number of valve flap apertures 531-535 may be decreased to decrease the flow of fluid through the disc ump 100.

About the periphery of the disc pump 100, the valve flap 130 is sandwiched between the isolator 150 and the pump base 110 so that the periphery is immobilized in a direction that is substantially perpendicular the surface of the valve flap 130. Yet the valve flap 130 is sufficiently flexible to allow the unconstrained portion of the valve flap 130 to deform, thereby opening a fluid flow path from the cavity 115 to isolator valve apertures 155, as described in more detail below.

The isolator 150 is also generally circular in shape and has a central portion and a peripheral portion 151. The piezoelectric disc 145 is mechanically coupled to a first side of the isolator 150 at the central portion. At the peripheral portion 151, the opposing side of the isolator 150 is mounted to the valve flap 130 over the upper surface 119 of the pump base 110. The peripheral portion 151 of the isolator 150 covers the isolator-facing surface 132 of the valve flap 130 which is sandwiched between the isolator 150 and the upper surface 119 of the pump base 110. The isolator 150 comprises relief apertures 153 through the peripheral portion 151 extending radially outwardly from the periphery of the piezoelectric disc 145 to provide additional flexibility when the piezoelectric disc 145 is energized and vibrates. The isolator 150 further comprises isolator valve apertures 155 positioned between the relief apertures 153 and the edge of the peripheral portion 151 of the isolator 150, each one of which is aligned to provide an opening for the perforations 135 of the valve flap 130. The isolator valve apertures 155 extend radially inwardly from the perforations 135 and the side wall 111 to overlap a peripheral portion 157 of the cavity 115 with the valve flap 130 still separating the isolator valve apertures 155 from the cavity 115.

Figure 4:
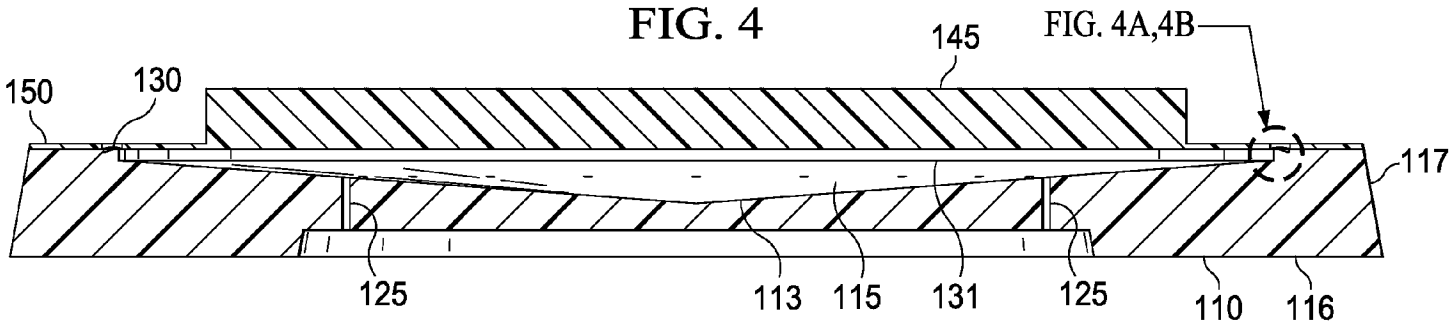
FIG. 4 shows a cross-section view of the disc pump of FIG. 1.
Figure 4B:
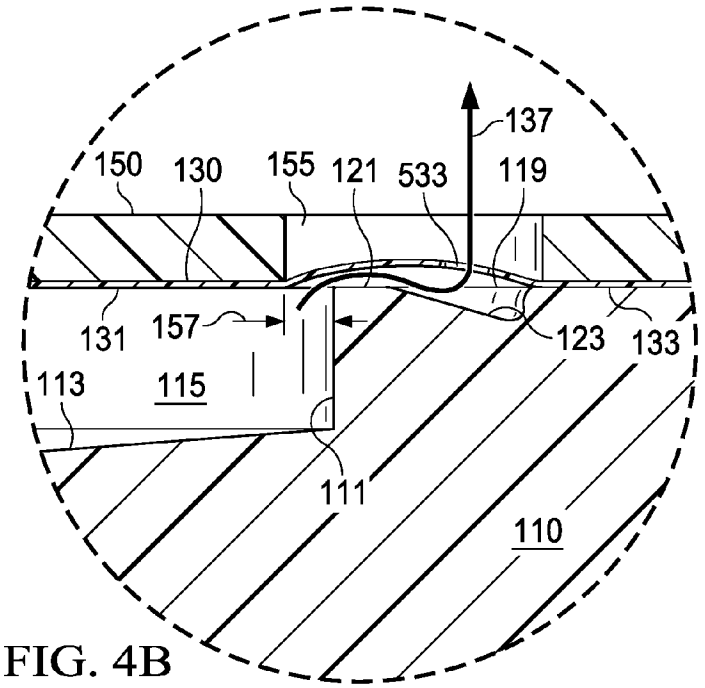
FIG. 4B shows a detail, cross-section view of the disc pump of FIG. 1, showing the valve portion of the disc pump indicated in FIG. 4, where the valve portion is in an open position.
Figure 4A:
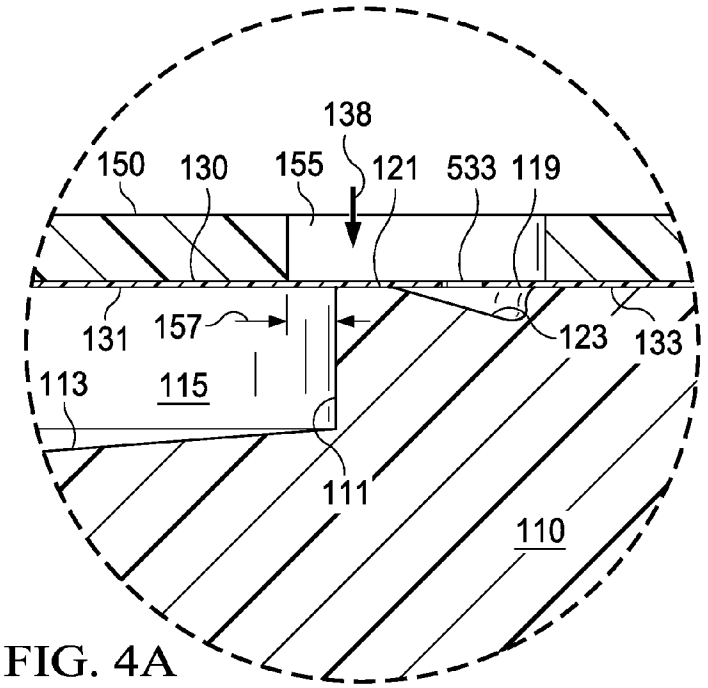
FIG. 4A shows a detail, cross-section view of the disc pump of FIG. 1, showing the valve portion of the disc pump indicated in FIG. 4, where the valve portion is in a closed position.

Referring more specifically to FIGS. 4A and 4B, the valve flap 130 is sufficiently flexible and resilient to deform to form a fluid flow path and to return to its original shape to create a seal. FIG. 4B shows the valve flap 130 in the deformed, or open position in which the valve flap 130 deforms within the isolator valve aperture 155 to form a path for fluid flow as shown by arrow 137. FIG. 4A shows the valve flap 130 in the sealed or closed position, in which the valve flap 130 has returned to its original shape to close the fluid flow path illustrated in FIG. 4B. When there is no pressure differential across the valve flap 130, the valve flap 130 is biased by the configuration of the pump elements and the resiliency of the material of the valve flap 130 in the normally closed, or "close biased" position. In another embodiment, a spacer or shim may be included between the pump base 110 and the valve flap 130 so that the valve will be biased in an open position. Inserting a spacer or shim may increase flow through the pump 100 by enlarging the fluid flow path between the valve flap 130 and the pump base 110 when the valve is in the neutral position.

When the pressure in the isolator valve aperture 155 equals or exceeds the pressure in the cavity 115 to create a differential pressure as indicated by arrow 138, the peripheral portion 133 of the valve flap 130 remains seated on the upper surface 119 of the pump base 110 to block fluid flow to the cavity 115. Since this is the original shape of the valve flap 130, the valve flap 130 is the to be normally biased in a "closed position" in which the valve flap 130 is substantially flat and seated on the sealing surface 121 of the pump base 110. When the pressure in the cavity 115 exceeds the pressure in the isolator valve aperture 155 to create a differential pressure in the opposite direction, the resultant force and fluid flow motivates the valve flap 130 away from the closed position to overcome the bias of the valve flap 130 and break the seal with the sealing surface 121 of the pump base 110. When the valve flap 130 is in this deformed state, the fluid flow path is formed by the valve flap 130 and the upper surface 119 of the pump base 110. As shown in FIG. 4B, the fluid flow path extends from the opening created by the peripheral portion 157 of the cavity 115 to the indentations 123 where the fluid flow path exits through the valve-flap apertures 531-535 as shown in FIG. 4B.

Figure 5A:
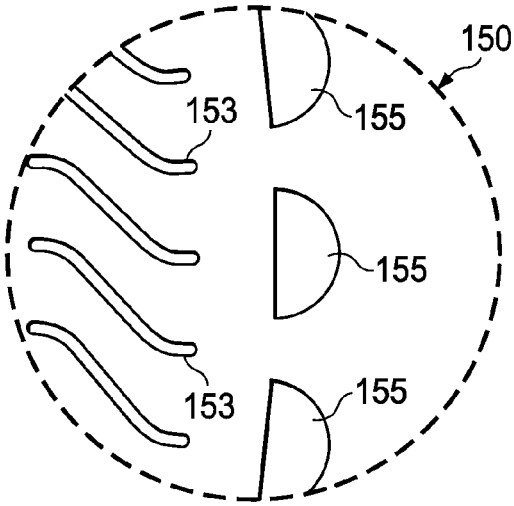
FIG. 5A is a detail, top view of the portion of the isolator indicated in FIG. 3.
Figure 5B:
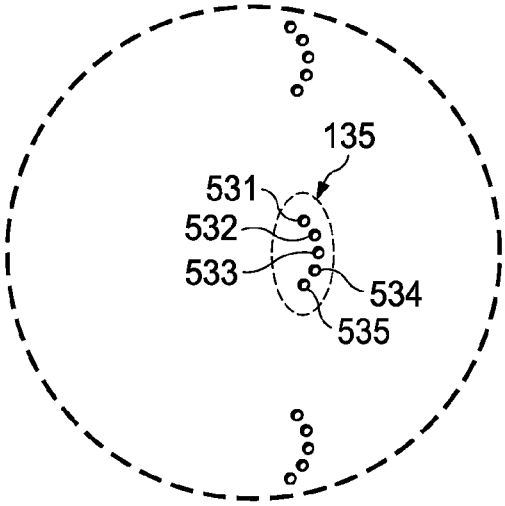
FIG. 5B is a detail, top view of the portion of the valve flap indicated in FIG. 3.
Figure 5C:
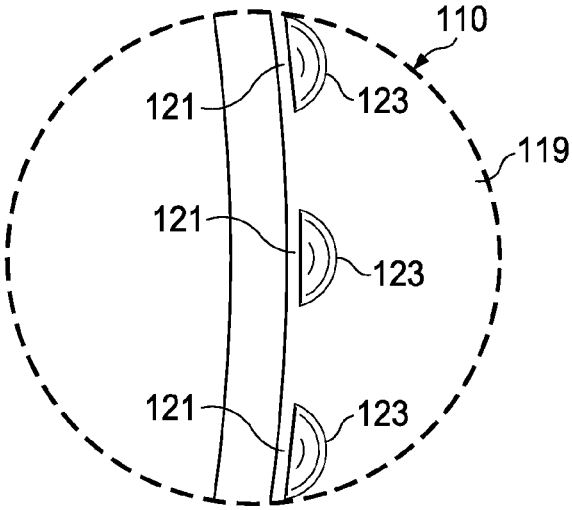
FIG. 5C is a detail, top view of the portion of the pump base indicated in FIG. 3.

FIGS. 5A, 5B, and 5C illustrate the features of the isolator 150, the valve flap 130, and the pump base 110, respectively, that form the valves of the disc pump 100. For example, FIG. 5A shows the isolator valve apertures 155 that allow fluid to escape the cavity 115 of the pump base 110 when the valve flap 130 is in the open position. In the assembled pump, the isolator valve apertures 155 generally overlie the valve flap apertures 531-535 shown in FIG. 5B. The valve flap apertures 531-535 also allow fluid to escape the cavity 115 when the valve flap 130 is in the open position. The valve flap apertures 531-535 generally overlie the indentations 123 of the pump base 110, shown in FIG. 5C. FIG. 5C also shows the sealing surfaces 121 of the pump base 110 that provide a reduced contact area adjacent the indentations 123. The valve flap 130 is motivated to the closed position by pressure and flow from the isolator valve aperture 155, and the surfaces of the pump base 110 that underlie the isolator valve aperture 155 support the valve flap 130. The indentations 123 serve to reduce the contact area between the valve flap 130 and the pump base 110 so that when the valve flap 130 is forced into the closed position, the force is applied over a smaller area of the pump base 110, which serves as the sealing surface 121.

Figure 6:
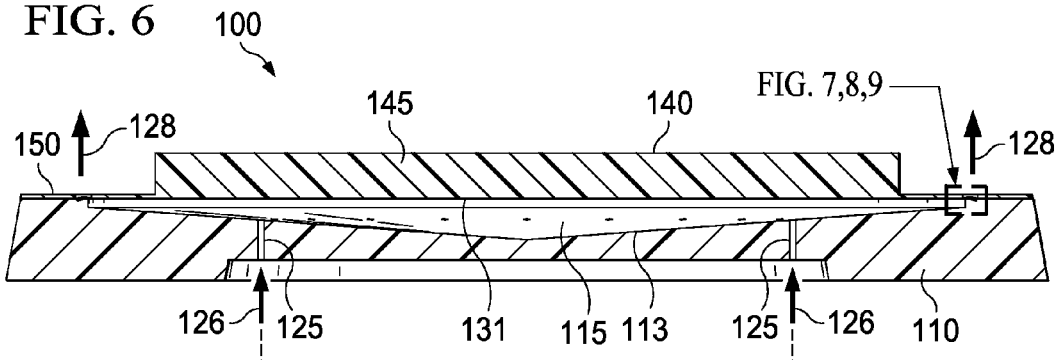
FIG. 6 shows a cross-section view of the disc pump of FIG. 1.

Turning now to FIG. 6, the valve(s) defined by the pump base 110, the valve flap 130, and the isolator 150 may be used in a pump that operates at extremely high frequencies, beyond the range of human hearing, for example. At such frequencies, the pump may be extremely small in size and suitable for integration into a wide range of portable electronic devices where pressure or vacuum delivery is required. The disc pump 100 comprises the pump base 110 having the substantially cylindrical shape cavity 115 formed by the side wall 111 and closed at both ends by the substantially circular end walls 113, 131 for containing a fluid. The disc pump 100 further comprises the actuator 140 operatively associated with the central portion of the end wall 131 to cause an oscillatory motion of the end wall 131 in a direction substantially perpendicular thereto with maximum amplitudes at about the center and periphery of the end wall 131, thereby generating displacement oscillations of the end wall 131 when in use. The disc pump 100 further comprises the isolator 150 operatively associated with the peripheral portion of the end wall 131 to reduce damping of displacement oscillations caused by the end wall's connection to the side wall 111 of the cavity 115. The pump base 110 further comprises the apertures 125 disposed in the end wall 113. When the actuator 140 generates an oscillatory motion of the end wall 131, the displacement oscillations generate radial oscillations of the fluid pressure within the cavity 115 of the pump base 110 and cause fluid to flow through the apertures 125 and the isolator valve apertures 155, as indicated by the arrows 126 and 128, respectively.

As noted above, the disc pump 100 also comprises a plurality of valves formed by the arrangement of the pump base 110, the valve flap 130 and the isolator 150. The plurality of valves are disposed about the periphery of the disc pump 100 and allow fluid to flow through the disc pump 100 in only one direction, as described above. For the valves to operate at the high frequencies generated by the actuator 140, the valves must have an extremely fast response time such that the valves are able to open and close on a time scale significantly shorter than the time scale of the pressure variations. The valves are disposed about the periphery of the cavity 115 so that fluid is drawn into the cavity 115 only through the inlet apertures 125. The fluid is expelled from the cavity 115 through pump outlets formed by the isolator valve apertures 155 as indicated by the solid arrows 128, thereby providing a source of reduced pressure at the inlet apertures 125. The term "reduced pressure" as used herein generally refers to a pressure less than the ambient pressure where the disc pump 100 is located. Although the term "vacuum" and "negative pressure" may be used to describe the reduced pressure, the actual pressure reduction may be significantly less than the pressure reduction normally associated with a complete vacuum. The pressure is "negative" in the sense that it is a gauge pressure, i.e., the pressure is reduced below ambient atmospheric pressure. Unless otherwise indicated, values of pressure stated herein are gauge pressures. References to increases in reduced pressure typically refer to a decrease in absolute pressure, while decreases in reduced pressure typically refer to an increase in absolute pressure.

Figure 6A:
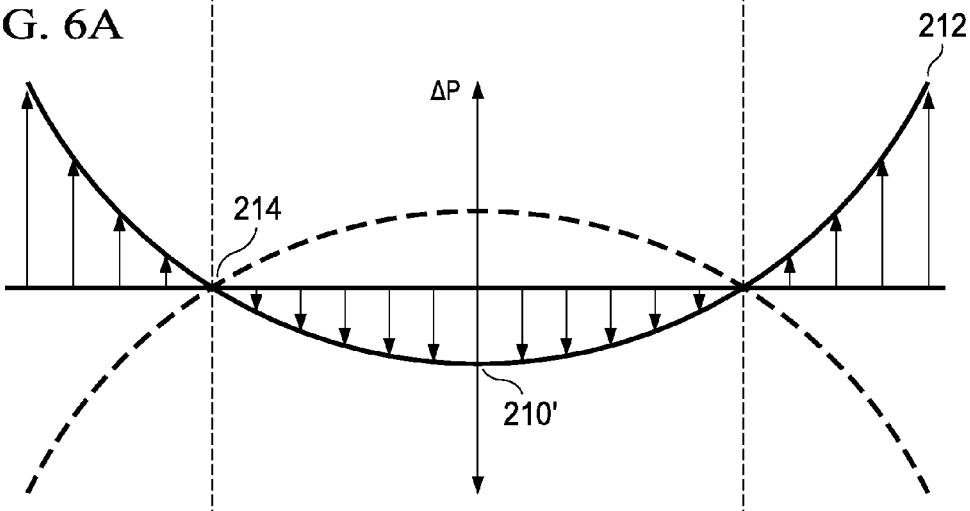
FIG. 6A shows a graph of pressure oscillations of fluid within the pump of FIG. 6 at a first time.

FIG. 6A shows one possible pressure oscillation profile illustrating the pressure oscillation within the cavity 115 resulting from the axial displacement oscillations of the end wall 131 described above. The solid curved line and arrows represent the pressure at one point in time, and the dashed curved line represents the pressure one half-cycle later. In this mode and higher-order modes, the amplitude of the pressure oscillations has a center pressure anti-node 210' around the center of the cavity 115 and a peripheral pressure anti-node 212 near the side wall 111 of the cavity 115 corresponding to the center displacement oscillations and the peripheral displacement oscillations (not shown) of the end wall 131. The amplitude of the pressure oscillations is substantially zero at an annular pressure node 214 between the center pressure anti-node 210' and the peripheral pressure anti-node 212. In an embodiment, the inlet apertures 125 of the pump base 110 are located at the same radial distance from the center of the cavity as the annular pressure node 214. The radial dependence of the pressure oscillations in the cavity 115 may be approximated by a Bessel function of the first kind. The radial change of the pressure is referred to as the "radial oscillations" of the fluid within the cavity 115 as distinguished from the axial pressure oscillations of the fluid within the cavity 115.

Figure 6B:
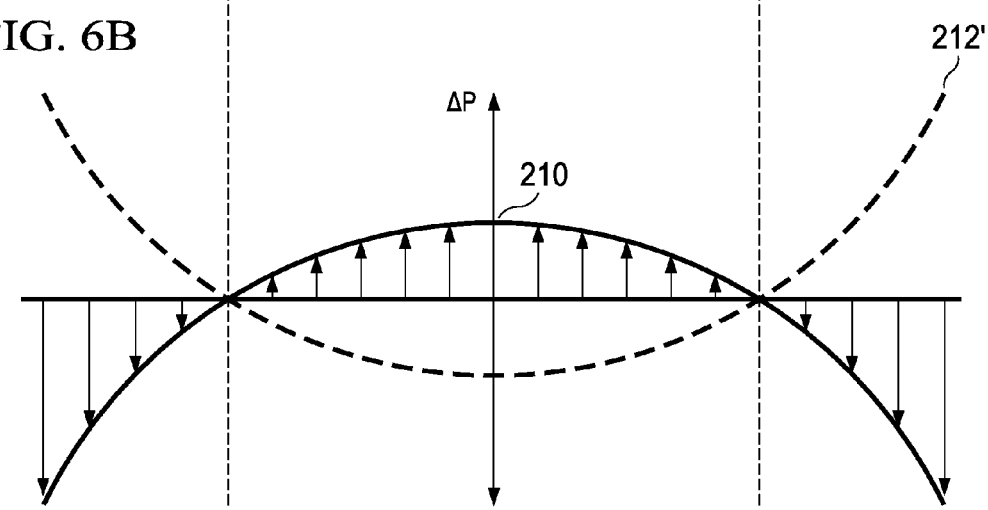
FIG. 6B shows a graph of pressure oscillations of fluid within the pump of FIG. 6 a half cycle later than the graph of FIG. 6A.

The pressure profile graphs of FIGS. 6A and 6B illustrate that the greatest change in pressure is exhibited at the central pressure anti-node 210' and peripheral pressure anti-node 212 of FIG. 6A and the central pressure anti-node 210 and peripheral pressure anti-node 212' of FIG. 6B. To maximize flow through the pump, it may be advantageous to locate the valve(s) that enable flow at the peripheral pressure anti-node 212, where the greatest combination of pressure differential and surface area may be available to provide a flow path for fluid through the disc pump 100.

Returning to FIG. 6, the fluid flow through the inlet apertures 125 as indicated by the solid arrows 126 corresponds to the fluid flow through the isolator valve apertures 155, as indicated by the solid arrows 128. As indicated above, the operation of the valves and the movement of the valve flap 130 between the open and closed positions is a function of the change in direction of the differential pressure (ΔP) of the fluid at the periphery of the cavity 115 for this embodiment of a disc pump. The differential pressure (ΔP) is assumed to be substantially uniform about the periphery of the cavity 115 because the side wall 111 location corresponds to the peripheral pressure anti-node 212 that is generated by the displacement oscillations of the end wall 131. Placing a large number of valve apertures 155 about the perimeter of the cavity 115 may enhance flow through the pump 100. Where a single valve at the center of a cavity places a valve at a singular high pressure area, the single valve is limited because the area of high pressure, the central pressure anti-node, is localized at the center of the cavity 115. Conversely, a multitude of valve apertures 155 about the perimeter of the cavity 115 may facilitate enhanced flow because the valve apertures 155 are spaced about an area of the cavity 115 that spans the cavity perimeter (i.e., the peripheral pressure anti-node).

Figure 7:
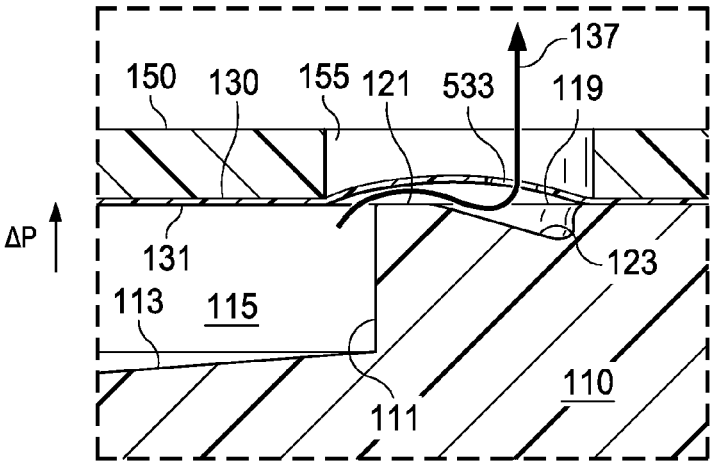
FIG. 7 shows a detail, section view of the valve portion of the pump in the open position as fluid is motivated through the valve.
Figure 8:
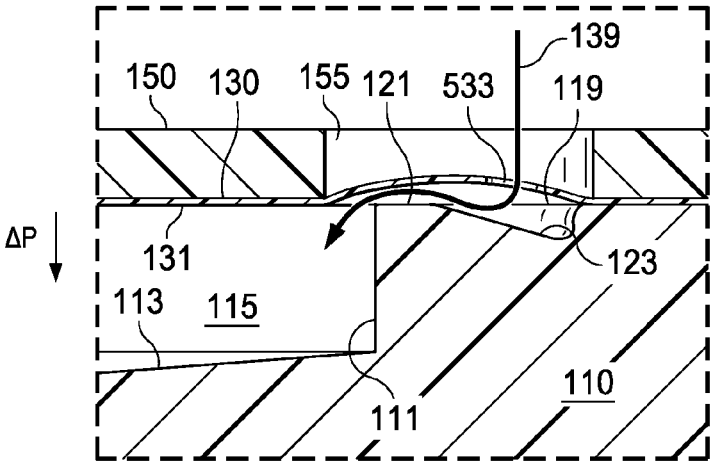
FIG. 8 shows a detail, section view of the valve portion of the pump as it begins to transition from the open position to the closed position.
Figure 9:
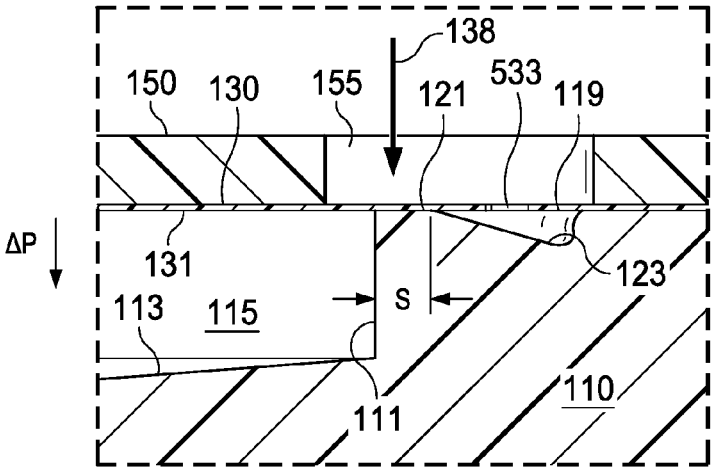
FIG. 9 shows a detail, section view of the valve portion of the pump after it has transitioned to the closed position.

FIGS. 7-9 illustrate the operation of the valve flap 130 in response to the radial pressure oscillations. In FIG. 7, the valve flap 130 is motivated away from the sealing surface 121 into the open position when the differential pressure across the valve flap 130 is a positive differential pressure (+ΔP). Thus, when the differential pressure results in a higher pressure in the cavity 115 than in the isolator valve aperture 155, the resultant flow of fluid motivates the valve flap 130 away from the sealing surface 121 of the pump base 110 into the open position. The movement of the valve flap 130 unblocks a fluid flow path between the sealing surface 121 and the valve flap 130 so that fluid is permitted to flow from the cavity 115 through the valve flap apertures 531-535 and isolator valve apertures 155, as indicated by the arrow 137.

FIG. 8 illustrates that in the absence of a pressure differential and the related fluid flow from the cavity 115, the valve flap 130 begins to move to the closed position. Thus, when the differential pressure changes back to the negative differential pressure (−ΔP), fluid begins to flow in the opposite direction as indicated by the arrow 139. The arrow 139 indicates the path of a small amount of fluid back flow, i.e., flow back through the isolator valve aperture 155. The backflow and pressure differential exert a force on the valve flap 130 that motivates the valve flap 130 to the closed position.

In the closed position illustrated in FIG. 9, valve flap 130 contacts the sealing surface 121, thereby blocking the fluid flow path illustrated by the arrow 137 of FIG. 7. As such, the valve flap 130 may act as a check valve that allows fluid to flow from the cavity 115 to the isolator valve aperture 155 in the open position before quickly returning to the closed position to block fluid from flowing in the opposite direction from the isolator valve aperture 155 to the cavity 115. In this manner, the pressure oscillations in the cavity 115 cycle the valve flap 130 between the closed and open positions, and the disc pump 100 provides a reduced pressure every half cycle when the valve flap 130 is in the open position.

In steady-state operation, pressure is applied against valve flap 130 by fluid in the cavity 115, which motivates the valve flap 130 away from the sealing surface 121, as shown in FIG. 7. As a result, the valve flap moves from the closed position to an open position over a period of time, i.e., an opening time delay ($T_o$), allowing fluid to flow in the direction indicated by the arrow 137. When the pressure is reversed, the valve flap 130 springs back against the sealing surface 121 to the closed position. When the pressure changes direction, fluid will flow in the reverse direction for a very short time period, a closing time delay ($T_c$), as indicated by the arrows 139 shown in FIG. 8. The differential pressure causes the valve flap 130 to block the flow path by sealing against the sealing surface 121, as shown in FIG. 9.

The opening and closing of the valve flap 130 is a function of the change in direction of the differential pressure (ΔP) of the fluid across the valve flap 130. In FIG. 8, the differential pressure has been assigned a negative value (−ΔP) as indicated by the downward pointing arrow. In this embodiment, when the differential pressure has a negative value (−ΔP), the fluid pressure in the isolator valve aperture 155 is greater than the fluid pressure in the cavity 115. This negative differential pressure (−ΔP) drives the valve flap 130 into the fully closed position as described above, wherein the valve flap 130 is pressed against the sealing surface 121 to block the flow path between the valve flap 130 and the sealing surface 121 and prevent the flow of fluid through the disc pump 100. When the differential pressure across the valve flap 130 reverses to become a positive differential pressure (+ΔP) as indicated by the upward pointing arrow 137 in FIG. 7, the valve flap 130 is again motivated away from the sealing surface 121 and against the isolator 150 into the open position. In this embodiment, when the differential pressure has a positive value (+ΔP), the fluid pressure in the cavity 115 is greater than the fluid pressure in the isolator valve aperture 155.

When the differential pressure changes back to a negative differential pressure (−ΔP) as indicated by the downward pointing arrow in FIG. 8, fluid begins flowing in the opposite direction as indicated by the arrow 139, which forces the valve flap 130 back toward the closed position shown in FIG. 9. In FIG. 9, the fluid pressure applied to the cavity side of the valve flap 130 is less than the fluid pressure applied to the isolator side of the valve flap 130. Thus, the valve flap 130 experiences a net force, represented by arrow 138, which accelerates the valve flap 130 toward the sealing surface 121 to close a valve formed by the arrangement of the valve flap 130, pump base 110, and isolator 150. In this manner, the changing differential pressure cycles the valve flap 130 between closed and open positions based on the direction (i.e., positive or negative) of the differential pressure across the valve flap 130.

Figures 10, 10A, 10B:
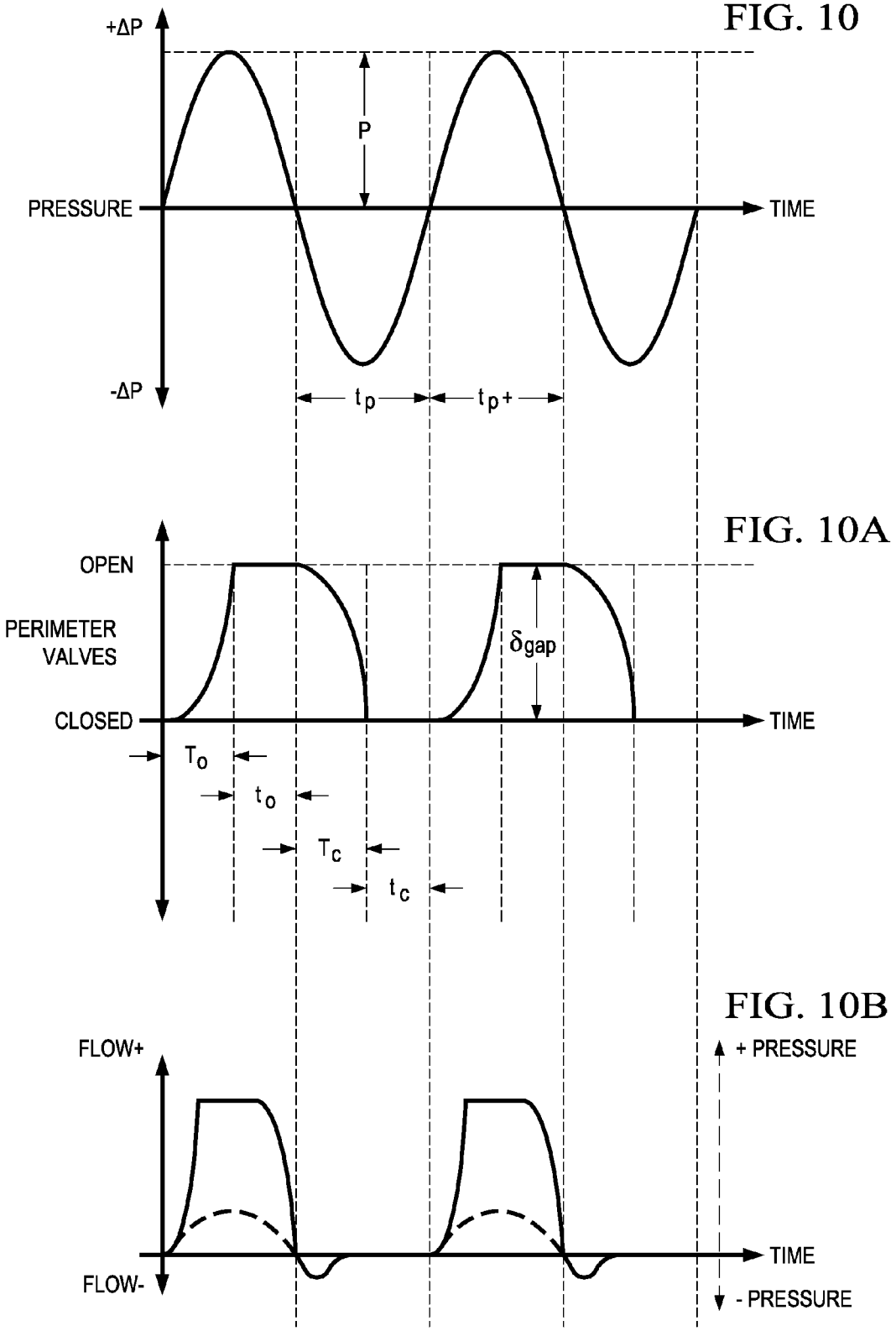
FIG. 10 shows a pressure graph of an oscillating differential pressure applied across the valve flap of the disc pump of FIG. 1.
FIG. 10A shows a graph of the position of the valve flap of the disc pump of FIG. 1 through an operating cycle of the valve.
FIG. 10B shows a fluid-flow graph of an operating cycle of the disc pump of FIG. 1 as the valve flap transitions between an open and closed position.

The differential pressure (ΔP) is assumed to be substantially uniform at the locations of the valves because the valve locations correspond to the peripheral pressure anti-node 212, as described above. Consequently, the cycling of the differential pressure (ΔP) between the positive differential pressure (+ΔP) and negative differential pressure (−ΔP) values can be represented by a square wave over the positive pressure time period ($t_{P+}$) and the negative pressure time period ($t_{P-}$), respectively, as shown in FIG. 10. As differential pressure (ΔP) cycles the valve flap 130 between the closed and open positions, the disc pump 100 provides a reduced pressure every half cycle when the valve flap 130 is in the open position subject to the opening time delay ($T_o$) and the closing time delay ($T_c$) as also described above and as shown in FIG. 10A. When the differential pressure across the valve flap is initially negative with the valve flap 130 closed (see FIG. 9) and reverses to become a positive differential pressure (+ΔP), the valve flap 130 is motivated away from the sealing surface 121 into the open position (see FIG. 7) after the opening time delay ($T_o$). In this position, the movement of the valve flap 130 unblocks the flow path between the sealing surface 121 and the valve flap 130 so that fluid is permitted to flow through the valve flap apertures 531-535 and overlying isolator valve apertures 155 of the isolator 150, thereby providing a source of reduced pressure outside the inlet apertures 125 of the disc pump 100 over an open time period ($t_o$), as shown in FIG. 10B. When the differential pressure changes back to the negative differential pressure (−ΔP), fluid begins to flow in the opposite direction through the valve (see FIG. 8) which forces the valve flap 130 back toward the closed position after the closing time delay ($T_c$). The valve flap 130 remains closed for the remainder of the half cycle or closed time period ($t_c$).

Regarding material selection, the isolator 150 should be rigid enough to withstand the fluid pressure oscillations to which it is subjected without significant mechanical deformation relative to the valve flap 130 at the periphery of the cavity 115. As such, the isolator 150 may be formed from a polymer sheet material of uniform thickness such as, for example, PET or Kapton. In one embodiment, the isolator 150 may be made from Kapton sheeting having a thickness of less than about 200 microns. The isolator 150 may also be made from a thin metal sheet of uniform thickness such as, for example, steel or brass, or another suitable flexible material. In another embodiment, the isolator 150 may be made from steel sheeting having a thickness of less than about 20 microns. The isolator 150 may be made of another flexible material suitable to facilitate vibration of the actuator 140 as described above. The isolator 150 may be glued, welded, clamped, soldered, or otherwise attached to the actuator 140 depending on the material used, and either the same process or a different process may be used to attach the isolator 150 to the pump base 110.

The valve flap 130 may be formed from a lightweight material, such as a metal or polymer film. In one embodiment, when fluid pressure oscillations of about 20 kHz or greater are present, the valve flap 130 may be formed from a thin polymer sheet between, about 1 micron and about 20 microns in thickness. For example, the valve flap 130 may be formed from polyethylene terephthalate (PET) or a liquid crystal polymer film approximately 3 microns in thickness. As shown in FIG. 8, the illustrative valve flap 130 merely flexes under the influence of a differential pressure and does not experience significant accelerations as would, for example, a valve flap being disposed a greater distance from the isolator 150. Nonetheless, the valve flap material should be robust enough to withstand the repeated flexing resulting from the oscillating differential pressure described above. In addition, minimizing the pressure drop incurred as air flows through the valve is important to maximizing valve performance as the pressure drop affects both the maximum flow rate and the maximum differential pressure that is achievable. Reducing the size of the valve flap apertures 531-535 increases the flow resistance and the pressure drop through the valve. According to an embodiment, analysis employing computational models and steady-state flow equations to approximate flow resistance through the valves may be used to improve the operation of the valves.

To estimate the pressure drop for flow through the apertures, a computational model may be applied that considers the fluid dynamic viscosity, the flow rate through the apertures, and the thickness of the valve flap 130. When the valve flap 130 is in the open position shown in FIG. 7, the flow of fluid through the gap between the valve flap 130 and the sealing surface 121 and the valve flap apertures 531-535 will propagate generally radially after exiting the valve flap apertures 531-535. Thus, the total pressure drop across the valve may be very sensitive to changes in the size of the valve flap apertures 531-535 as well as the gap ($d_{gap}$) between the valve flap 130 and the sealing surface 121 when the valve flap 130 is in the open position. It should be noted that a smaller gap $d_{gap}$, which can be desirable in order to minimize the opening time delay ($T_o$) and the closing time delay ($T_c$) of the valve flap 130, may increase the pressure loss. For example, reducing the flap gap $d_{gap}$ from about 25 microns to about 20 microns may double the pressure loss.

Consideration also should be given to maintaining the stress experienced by the valve flap 130 within acceptable limits during operation of the valve, which typically requires a larger sealing surface 121. In one embodiment, the gap $d_{gap}$ value may be selected such that the gap pressure drop is equal to the hole pressure drop. In one embodiment, the size of the gap $d_{gap}$ falls within an approximate range between about 5 microns and about 150 microns, although more preferably within a range between about 15 and about 50 microns.

FIG. 7 illustrates a valve portion of the disc pump of FIG. 1 in the open position. In this position, the valve flap 130 is subjected to stress as the valve flap 130 opens the gap that serves as the flow path between the valve flap 130 and the sealing surface 121. The opening of the valve causes the valve flap 130 to deform toward the isolator 150 to allow fluid to flow through the valve flap aperture 531-535 as illustrated. The level of stress on the valve flap 130 in this configuration increases with the diameter of the isolator valve aperture 155 in the isolator 150. The material of the valve flap 130 will tend to fracture more easily if the diameter of the isolator valve aperture 155 is too large, thus leading to failure of the disc pump 100. In order to reduce the likelihood that the material of the valve flap 130 fractures, the size of the isolator valve apertures 155 may be reduced to limit the stress experienced by the valve flap 130 to a level which is below the fatigue stress of the material of the valve flap 130.

The maximum stress experienced by the material of the valve flap 130 in operation may be estimated using computational models. In one embodiment of the invention, the valve flap 130 is formed from a thin polymer sheet, such as Mylar having a Poisson ratio of 0.3, and is clamped to the sealing surface 121 about the perimeter of the pump base 110. Considering the high number of stress cycles applied to the valve flap 130 during the operation of the valve, the maximum stress per cycle tolerated by the valve flap 130 should be significantly lower than the yield stress of the material of the valve flap 130. Limiting the maximum stress per cycle to be significantly less than the yield stress of the material of the valve flap 130 in order to reduce the possibility that the valve flap 130 suffers a fatigue fracture, especially at the portion of the valve flap 130 that flexes upward to allow fluid flow. Based on fatigue data compiled for a high number of cycles with respect to similar valve structures, it has been determined that the actual yield stress of the material of the valve flap 130 should be at least about four times greater than the stress applied to the material of the valve flap 130 (e.g., 16, 34, and 43 MPa as calculated above). Thus, the valve flap material should have a yield stress as high as 150 MPa to minimize the likelihood of such fractures for a maximum equivalent diameter of the isolator valve apertures 155 in this case of approximately 200 microns.

Reducing the equivalent diameter of the isolator valve apertures 155 beyond the maximum equivalent diameter of the isolator valve apertures 155 may be desirable as it further reduces valve flap 130 stress and has no significant effect on valve flow resistance until the diameter of the equivalent isolator valve apertures 155 approaches the same size as the gap $d_{gap}$. Further, reduction in the size of the isolator valve apertures 155 permits the inclusion of an increased number of isolator valve apertures 155 per unit area of the isolator surface for a given sealing length (s). However, the size of the isolator valve apertures 155 may be limited, at least in part, by the manner in which the isolator 150 is fabricated. For example, chemical etching limits the size of the isolator valve apertures 155 to be equal to or greater than the thickness of the isolator 150 in order to achieve repeatable and controllable results. In one embodiment, the isolator valve apertures 155 in the isolator 150 are between about 20 microns and about 500 microns in diameter. In other embodiments the isolator valve apertures 155 in the isolator 150 are between about 100 and about 200 microns in diameter depending on the other factors described above.

Within the disc pump 100, the thickness of the material of the valve flap 130 (e.g., 3 μm Mylar) is a factor in the speed of the valve operation and therefore a contributor to the performance of the disc pump 100. As a result, pumps assembled with about a 1.5 μm valve flap 130 with about a 20 μm gap may yield increased performance over valves having about a 3 μm valve flap with about a 20 μm gap. A wider valve gap may also increase performance, such that about a 60 μm gap may yield improved performance over about a 20 μm gap with about a 3 μm valve flap 130. It is possible to increase performance by creating a valve having, for example, a thinner valve flap 130 of about a 1.5 μm thickness and about a 60 μm gap. Yet to create such a valve, material concerns must be overcome to address the additional strain place on a thinner material. This concern is mitigated by biasing the valve flap 130 toward the center of the valve cavity 115. The individual valve flap apertures 531-535 may be formed partially by precision injection molding the valve flap 130, and partly by laser drilling or a similar process. To form the pump 100 and integrated valves, the valve flap 130 can be directly mounted to the isolator 150. The isolator 150 and valve flap 130 may then be fastened to the pump base 110 by a suitable joining process, such as heat staking.

The inlet apertures 125 are shown in, e.g., FIG. 6, as being located at the annular pressure node 214. Yet in another embodiment the inlet apertures 125 may instead be located near the center of the of the pump base 110 at the central pressure anti-node 210. In such an embodiment, a ring-like isolator structure and a valve flap structure may be installed adjacent the inlet apertures 125, thereby creating an inlet valve. In such an embodiment, the valve structure discussed above would function as an outlet valve, or exhaust valve. Alternatively, a peripheral valve arrangement discussed above may be installed at the pump base 110, thereby utilizing the center pressure anti-node to increase the pressure in the cavity of the pump before further increasing the pressure at the exhaust valve, e.g., the isolator valve aperture 155, as discussed above.

Together, the illustrative embodiments provide a method for forming valves around the periphery of a pump cavity 115 at the location of the peripheral pressure anti-node 212. By providing an increased area for including valves in the pump cavity 115, the disc pump 100 of the illustrative embodiments may provide greater flow than a similar pump having a centrally mounted valve. By isolating incorporating a multitude of small valves into the structure of the disc pump 100, manufacturing may be simplified. Moreover, the multitude of valves provides a degree of redundancy, such that if one of the valve flap apertures is blocked or is fractured, the remaining valves will remain functional.

It should be apparent from the foregoing that embodiments having significant advantages have been provided. While the embodiments are shown in only a few of its forms, it is not just limited but is susceptible to various changes and modifications without departing from the spirit thereof.

We claim:

1. A disc pump comprising:

a pump base having a cylindrical sidewall closed at a first end by a first end wall to form a cavity and an upper surface extending radially outwardly from the sidewall, the upper surface including a sealing surface and at least one indentation;

at least one aperture extending through the pump base into the cavity;

an actuator including a piezoelectric disc and an isolator extending radially outwardly between the piezoelectric disc and the sidewall, the actuator comprising a second end wall on a second end of the cylindrical sidewall and the piezoelectric disc being configured to cause an oscillatory motion of the second end wall, thereby generating displacement oscillations of the second end wall in a direction substantially perpendicular to the second end wall, the displacement oscillations configured to generate corresponding radial pressure oscillations of the fluid within the cavity, and the isolator being configured to reduce dampening of the displacement oscillations;

at least one isolator valve aperture extending through the isolator and having an opening proximate the upper surface of the pump base and a peripheral portion of the cavity; and a valve flap disposed between the opening of the isolator valve aperture on one side and the upper surface of the pump base and the peripheral portion of the cavity on the other side, the valve flap having at least one valve flap aperture extending between the opening of the isolator valve aperture and the indentation;

wherein the valve flap prevents the flow of fluids through the isolator valve aperture when seated against the sealing surface and permits the flow of fluids through the indentation and the isolator valve aperture when not seated against the sealing surface.

2. The disc pump of claim 1, wherein the at least one aperture comprises a plurality of apertures circumferentially disposed about a center of the first end wall.

3. The disc pump of claim 1, wherein the at least one aperture comprises a plurality of apertures circumferentially disposed about a center of the first end wall at a predetermined distance from the center of the first end wall.

4. The disc pump of claim 1, wherein the at least one aperture comprises a plurality of apertures circumferentially disposed about a center of the first end wall at a predetermined distance from the center of the first end wall corresponding to the radial distance of an annular pressure node from the center of the first end wall.

5. The disc pump of claim 1, wherein the at least one indentation comprises a plurality of indentations circumferentially disposed in the upper surface proximate to a periphery of the cavity.

6. The disc pump of claim 1, wherein the at least one isolator valve aperture comprises a plurality of isolator valve apertures circumferentially disposed around a periphery of the isolator.

7. The disc pump of claim 1, wherein the at least one valve flap aperture comprises a plurality of valve flap apertures circumferentially disposed around a periphery of the valve flap.

8. The disc pump of claim 1, wherein the at least one indentation comprises a plurality of indentations circumferentially disposed in the upper surface proximate to a periphery of the cavity, the at least one isolator valve aperture comprises a plurality of isolator valve apertures circumferentially disposed around a periphery of the isolator, and the at least one valve flap aperture comprises a plurality of valve flap apertures, and wherein the indentations, the isolator valve apertures, and the valve flap apertures are substantially aligned.

9. The disc pump of claim 1, wherein the at least one indentation comprises a plurality of indentations circumferentially disposed in the upper surface proximate to a periphery of the cavity, the at least one isolator valve aperture comprises a plurality of isolator valve apertures circumferentially disposed around a periphery of the isolator, and the at least one valve flap aperture comprises a plurality of valve flap apertures, and wherein the indentations and the isolator valve apertures are substantially aligned and each respective indentation and isolator valve aperture is aligned with a respective valve flap aperture of the plurality of valve flap apertures.

10. The disc pump of claim 1, wherein the valve flap includes at least one perforation disposed on the peripheral portion of the valve flap and adjacent the at least one indentation.

11. The disc pump of claim 1, wherein the valve flap includes a plurality of perforations disposed on the peripheral portion of the valve flap, the at least one indentation comprises a plurality of indentations, and the plurality of perforations are adjacent the plurality of indentations.

12. The disc pump of claim 1, wherein the valve flap includes at least one perforation disposed on the peripheral portion of the valve flap and adjacent the at least one indentation, the at least one valve flap aperture comprises a plurality of valve flap apertures, and the at least one perforation includes the plurality of valve flap apertures.

13. The disc pump of claim 1, wherein the valve flap includes at least one perforation disposed on the peripheral portion of the valve flap and adjacent the at least one indentation, the at least one valve flap aperture comprises a plurality of valve flap apertures, and the at least one perforation includes the plurality of valve flap apertures arranged in an arcuate pattern adjacent the outer periphery of the indentation.

14. The disc pump of claim 1, wherein the isolator valve aperture extends generally perpendicularly through the isolator.

15. The disc pump of claim 1, wherein:

the valve flap is motivated away from the sealing surface when the pressure in the cavity exceeds the pressure on an opposing side of the isolator;

the valve flap is motivated against the sealing surface when the pressure on the opposing side of the isolator exceeds the pressure in the cavity.

16. The disc pump of claim 1, wherein the valve flap is formed from a polymer having a thickness of about 1.5 microns.

17. The disc pump of claim 1, wherein the valve flap comprises a light-weight material selected from the group consisting of a polymer and a metal.

18. The disc pump of claim 17, wherein the light-weight material is a polymer having a thickness of less than about 20 microns.

19. The disc pump of claim 18, wherein the polymer is polyethylene terephthalate having a thickness of about 1.5 microns.

20. The disc pump of claim 18, wherein the polymer is a liquid crystal film having a thickness of about 1.5 microns.

21. The disc pump of claim 18, wherein the polymer is a Mylar film having a thickness of about 1.5 microns.

22. The disc pump of claim 1, wherein the isolator valve aperture is less than about 500 microns in diameter.

23. The disc pump of claim 22, wherein the valve flap is formed from a polymer having a thickness of about 1.5 microns, and the isolator valve aperture is less than about 500 microns in diameter.

24. The disc pump of claim 1, wherein the isolator is heat staked to the pump base.

25. The disc pump of claim 1, wherein the valve flap seats to the sealing surface and flexes away from the sealing surface in response to a change in direction of the differential pressure.

26. The disc pump valve of claim 25, wherein the valve flap has a response time delay less than about twenty-five percent of a time period of the differential pressure oscillations.

27. The disc pump valve of claim 25, wherein the change in direction of the differential pressure oscillates at a frequency of greater than about 20 kHz.

* * * * *